US007664451B2

(12) United States Patent
Baba et al.

(10) Patent No.: US 7,664,451 B2
(45) Date of Patent: Feb. 16, 2010

(54) FIXING DEVICE AND IMAGE FORMING APPARATUS

(75) Inventors: Motofumi Baba, Kanagawa (JP); Yasuhiro Uehara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 195 days.

(21) Appl. No.: 11/889,841

(22) Filed: Aug. 16, 2007

(65) Prior Publication Data

US 2008/0240808 A1 Oct. 2, 2008

(30) Foreign Application Priority Data

Mar. 29, 2007 (JP) ..... 2007-088684

(51) Int. Cl.
*G03G 15/20* (2006.01)

(52) U.S. Cl. ..... 399/329; 399/328

(58) Field of Classification Search ..... 399/328, 399/329, 336

See application file for complete search history.

(56) References Cited

U.S. PATENT DOCUMENTS 6,097,926 A * 8/2000 Takagi et al. ..... 399/328
RE38,810 E * 10/2005 Terada et al. ..... 399/328
2006/0088324 A1* 4/2006 Fujimoto et al. ..... 399/33
2007/0014601 A1* 1/2007 Yasuda et al. ..... 399/329

FOREIGN PATENT DOCUMENTS

| | | |
|---|---|---|
| JP | A 09-026717 | 1/1997 |
| JP | A 2003-124035 | 4/2003 |
| JP | A 2004-094266 | 3/2004 |
| JP | A 2006-208909 | 8/2006 |

OTHER PUBLICATIONS

Nanocrystalline soft magnetic material FINEMET®, Hitachi Apr. 2005.*

* cited by examiner

*Primary Examiner*—David M Gray
*Assistant Examiner*—Gregory H Curran
(74) *Attorney, Agent, or Firm*—Morgan, Lewis & Bockius LLP

(57) ABSTRACT

A fixing device includes: a magnetic field generating component that generates a magnetic field; a fixing member including a heat generating layer that is electromagnetically induced by the magnetic field to generate heat; a support disposed at an inner side of the fixing member; a pressure rotating body that applies pressure to the fixing member in the direction of the support; and a pair of magnetic circuit forming members that are disposed with the fixing member and the magnetic field generating component being placed therebetween and can be used while having either elastic deformation or plastic deformation applied thereto.

14 Claims, 5 Drawing Sheets

FIXING DEVICE AND IMAGE FORMING APPARATUS

CROSS-REFERENCE TO RELATED APPLICATION

This application is based on and claims priority under 35 USC 119 from Japanese Patent Application No. 2007-088684 filed on Mar. 29, 2007.

BACKGROUND

1. Technical Field

The present invention relates to a fixing device and an image forming apparatus.

2. Related Art

Conventionally, in image forming apparatus such as printers and copiers that perform image formation using the electrophotographic system, a fixing device is utilized which passes a toner image that has been transferred onto recording paper through a nip portion formed by a fixing roller or a fixing belt disposed with a heat source such as a halogen heater and a pressure roller and which melts the toner by the action of heat and pressure to fix the toner image to the recording paper.

As the heat source, there are fixing devices of the electromagnetic induction heat generating system using a coil that generates a magnetic field as a result of electrical power being supplied thereto and a heat generating body that generates heat as a result of an eddy current being formed by electromagnetic induction of the magnetic field.

In fixing devices of the electromagnetic induction heat generating system, in order to effectively utilize the magnetic field generated by the coil, there is a fixing device where a core material and a magnetic circuit forming member configured by a magnetic material are disposed in a position adjacent to the coil so that a magnetic circuit is formed between them and the coil magnetic field.

SUMMARY

A first aspect of the present invention is a fixing device including: a magnetic field generating component that generates a magnetic field; a fixing member including a heat generating layer that is electromagnetically induced by the magnetic field to generate heat; a support disposed at an inner side of the fixing member; a pressure rotating body that applies pressure to the fixing member in the direction of the support; and a pair of magnetic circuit forming members that are disposed with the fixing member and the magnetic field generating component being placed therebetween and at least one of said magnetic circuit forming members can be used while having either elastic deformation or plastic deformation applied thereto.

BRIEF DESCRIPTION OF THE DRAWINGS

Exemplary embodiments of the present invention will be described in detail based on the following figures, wherein.

DETAILED DESCRIPTION

A first exemplary embodiment of a fixing device and an image forming apparatus of the present invention will be described on the basis of the drawings.

Figure 1:
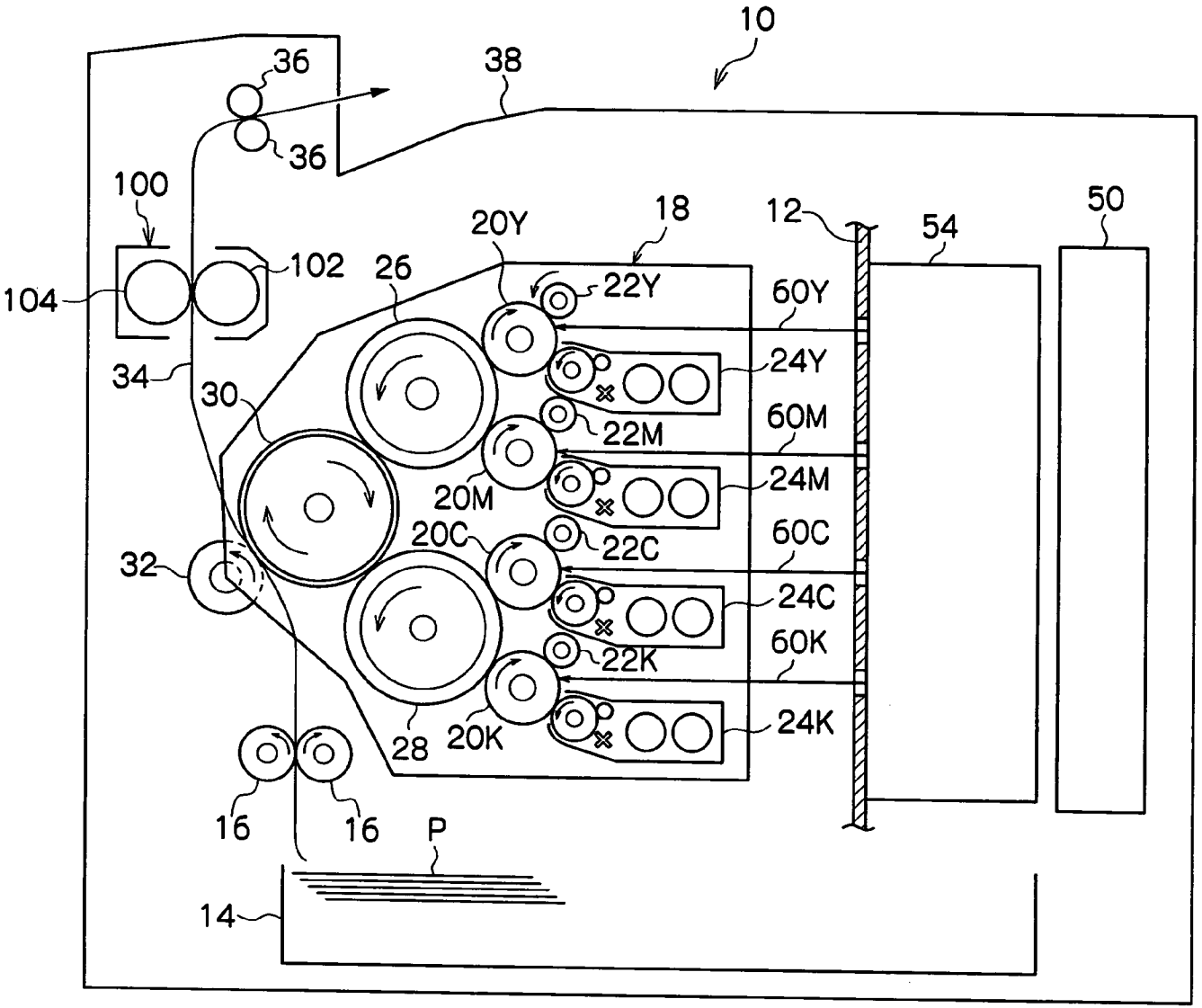
FIG. 1 is an overall diagram of an image forming apparatus pertaining to a first exemplary embodiment of the present invention.

In FIG. 1, there is shown a printer 10 serving as an image forming apparatus.

In the printer 10, an optical scanning device 54 is fixed to a casing 12 that configures the body of the printer 10, and a control unit 50 that controls the operation of the optical scanning device 54 and each component of the printer 10 is disposed in a position adjacent to the optical scanning device 54.

The optical scanning device 54 scans a light beam emitted from an unillustrated light source with a rotating polygon mirror, reflects the light beam with plural optical parts such as reflecting mirrors, and emits light beams 60Y, 60M, 60C and 60K corresponding to the respective toners of yellow (Y), magenta (M), cyan (C) and black (K).

The light beams 60Y, 60M, 60C and 60K are guided to corresponding photoconductors 20Y, 20M, 20C and 20K.

A paper tray 14 that holds recording paper P is disposed in the lower portion of the printer 10. A pair of registration rollers 16 that adjust the position of the leading end portion of the recording paper P is disposed above the paper tray 14.

An image forming unit 18 is disposed in the center portion of the printer 10. The image forming unit 18 is disposed with the aforementioned four photoconductors 20Y, 20M, 20C and 20K, and these are arranged in a vertical row.

Charging rollers 22Y, 22M, 22C and 22K that charge the surfaces of the photoconductors 20Y, 20M, 20C and 20K are disposed on the rotational direction upstream sides of the photoconductors 20Y, 20M, 20C and 20K.

Further, developing devices 24Y, 24M, 24C and 24K that develop the toners of Y, M, C and K on the photoconductors 20Y, 20M, 20C and 20K are disposed on the rotational direction downstream sides of the photoconductors 20Y, 20M, 20C and 20K.

A first intermediate transfer body 26 contacts the photoconductors 20Y and 20M, and a second intermediate transfer body 28 contacts the photoconductors 20C and 20K. Additionally, a third intermediate transfer body 30 contacts the first intermediate transfer body 26 and the second intermediate transfer body 28.

A transfer roll 32 is disposed in a position facing the third intermediate transfer body 30. The recording paper P is conveyed between the transfer roll 32 and the third intermediate transfer body 30, and a toner image on the third intermediate transfer body 30 is transferred to the recording paper P.

A fixing device 100 is disposed downstream on a paper conveyance path 34 along which the recording paper P is conveyed. The fixing device 100 includes a fixing belt 102 and a pressure roll 104 that heat and pressure the recording paper P to cause the toner image to be fixed onto the recording paper P.

The recording paper P to which the toner image has been transferred is discharged by paper conveying rolls 36 into a tray 38 disposed in the upper portion of the printer 10.

Here, image formation by the printer 10 will be described.

When image formation is started, the surfaces of the photoconductors 20Y to 20K are uniformly charged by the charging rollers 22Y to 22K.

The charged surfaces of the photoconductors 20Y to 20K are irradiated with the light beams 60Y to 60K corresponding to an output image from the optical scanning device 54, and electrostatic latent images corresponding to respective color separated images are formed on the photoconductors 20Y to 20K.

The developing devices 24Y to 24K selectively apply toners of the respective colors—that is, Y to K—to the electrostatic latent images, and toner images of the colors of Y to K are formed on the photoconductors 20Y to 20K.

Thereafter, the magenta toner image is primarily transferred from the magenta-use photoconductor 20M to the first intermediate transfer body 26. Further, the yellow toner image is primarily transferred from the yellow-use photoconductor 20Y to the first intermediate transfer body 26 and is superposed on the magenta toner image on the first intermediate transfer body 26.

In the same manner, the black toner image is primarily transferred from the black-use photoconductor 20K to the second intermediate transfer body 28. Further, the cyan toner image is primarily transferred from the cyan-use photoconductor 20C to the second intermediate transfer body 28 and is superposed on the black toner image on the second intermediate transfer body 28.

The magenta and yellow toner images that have been primarily transferred to the first intermediate transfer body 26 are secondarily transferred to the third intermediate transfer body 30. The black and cyan toner images that have been primarily transferred to the second intermediate transfer body 28 are also secondarily transferred to the third intermediate transfer body 30.

Here, the magenta and yellow toner images that are secondarily transferred first and the cyan and black toner images are superposed, and a color (three colors) and black full-color toner image is formed on the third intermediate transfer body 30.

The secondarily transferred full-color toner image reaches a nip portion between the third intermediate transfer body 30 and the transfer roll 32. In synchronization with that timing, the recording paper P is conveyed from the registration rolls 16 to the nip portion, and the full-color toner image is tertiarily transferred (finally transferred) onto the recording paper P.

The recording paper P is thereafter sent to the fixing device 100 and passes through a nip portion between the fixing belt 102 and the pressure roll 104. At this time, the full-color toner image is fixed to the recording paper P by the action of heat and pressure applied from the fixing belt 102 and the pressure roll 104. After the full-color toner image has been fixed to the recording paper P, the recording paper P is discharged by the paper conveying rolls 36 into the tray 38, and full-color image formation on the recording paper P ends.

Next, the fixing device 100 pertaining to the present exemplary embodiment will be described.

Figure 2A:
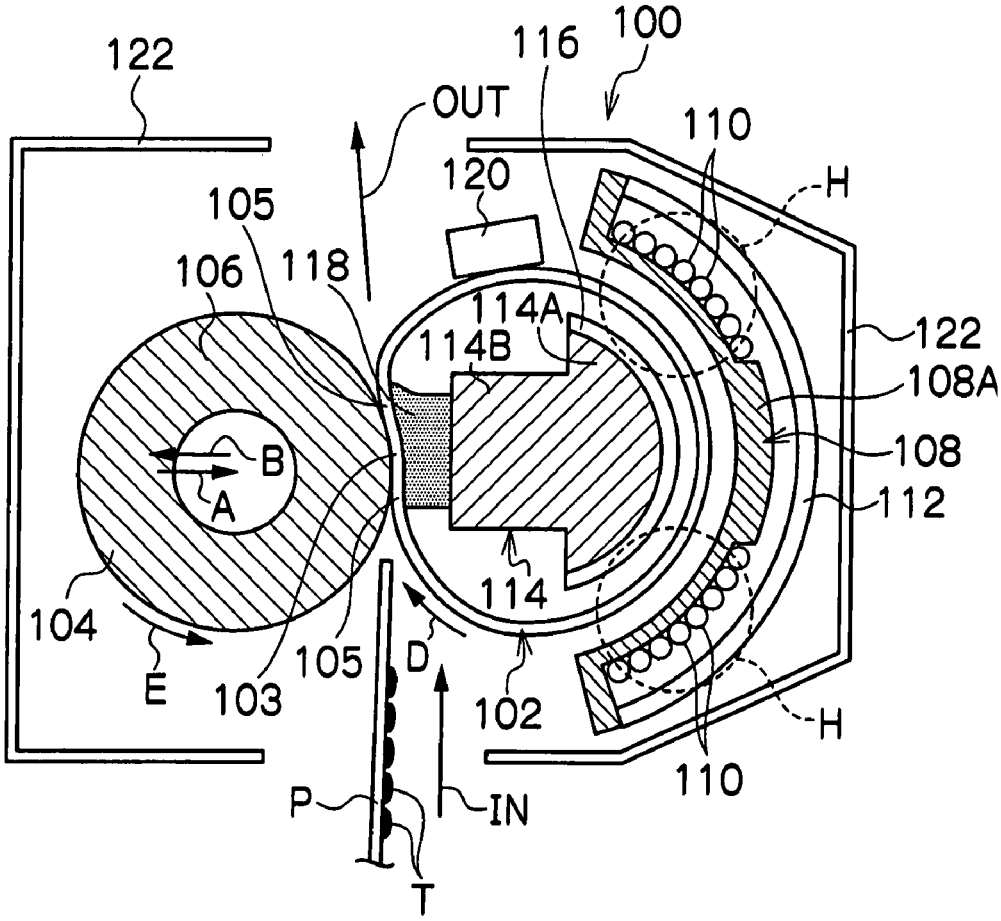
FIG. 2A is a cross-sectional diagram of a fixing device pertaining to the first exemplary embodiment of the present invention.

As shown in FIG. 2A, the fixing device 100 is disposed with a casing 122 in which openings for allowing the recording paper P to enter or exit are formed.

The fixing belt 102, which is endless and rotates in the direction of arrow D, is disposed inside the casing 122.

A bobbin 108 configured by an insulating material is disposed in a position facing the outer peripheral surface of the fixing belt 102. The distance between the bobbin 108 and the fixing belt 102 is about 1 to 3 mm. The bobbin 108 is formed in a substantially circular arc shape that follows the outer peripheral surface of the fixing belt 102, and a convex portion 108A is disposed so as to project.

An excitation coil 110 is wound several times onto the bobbin 108 around the convex portion 108A in the axial direction (depth direction of the page of FIG. 2A).

A magnetic circuit forming member 112 formed in a substantially circular arc shape following the circular arc shape of the bobbin 108 is disposed in a position facing the excitation coil 110 and is supported on the bobbin 108.

A support member 114 comprising aluminium that is a nonmagnetic body is disposed on the inner side of the fixing belt 102 without contacting the fixing belt 102, and both ends of the support member 114 are fixed to the casing 122 of the fixing device 100.

The support member 114 is configured by a circular arc portion 114A, which faces the fixing belt 102 and is formed in a circular arc shape, and a column portion 114B, which is formed in a column shape. The circular arc portion 114A and the column portion 114B are integrally molded.

A magnetic circuit forming member 116 comprising the same material as that of the aforementioned magnetic circuit forming member 112 is disposed along the circular arc portion 114A on the circular arc portion 114A of the support member 114. The magnetic circuit forming member 116 does not contact the fixing belt 102. A closed magnetic circuit resulting from a magnetic field H that is generated when electricity is supplied to the excitation coil 110 is formed between the magnetic circuit forming member 116 and the magnetic circuit forming member 112.

Here, the magnetic circuit forming members 112 and 116 will be described.

Figure 4A:
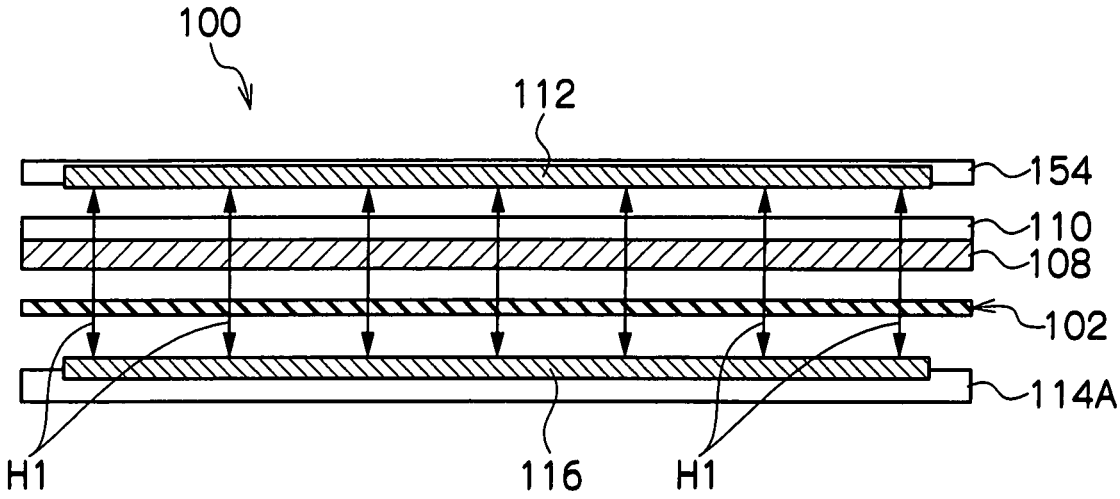
FIG. 4A is a schematic diagram showing the arrangement of magnetic circuit forming members pertaining to the first exemplary embodiment of the present invention.

As shown in FIG. 4A, the magnetic circuit forming members 112 and 116 are disposed facing each other, and both extend long in the axial direction of the fixing belt 102 (left-right direction of the page of FIG. 4A). The magnetic circuit forming member 112 is supported by a support member 154 disposed between the magnetic circuit forming member 112 and the aforementioned casing 122 (see FIG. 2A).

The magnetic field H (see FIG. 2A) generated by the excitation coil 110 is configured to form a closed magnetic circuit as a magnetic field H1 between the magnetic circuit forming members 112 and 116.

Further, at least one of the magnetic circuit forming members 112 and 116 are formed by an amorphous non-crystalline metal whose main component is iron (Fe) and are capable of having either elastic deformation or plastic deformation applied thereto and being used. As an example, FINEMET, whose main component is iron (Fe) and to which silicon (Si), boron (B), a minute amount of copper (Cu), and niobium (Nb) have been added, can be used. FINEMET is a registered trademark of Hitachi Metals, Ltd (see JP-A No. 6-93390 and JP-A No. 10-8224).

The magnetic circuit forming members 112 and 116 have high magnetic permeability (relative magnetic permeability of 1000 or greater) and high resistivity ($1\times10^{-6}\Omega$m or greater). Further, it was understood as a result of verification by temperature distribution, heat generating efficiency and power factor that it is preferable for the thickness of the magnetic circuit forming members 112 and 116 to be 0.05 mm or greater. Further, it is preferable for a thickness t of the magnetic circuit forming members 112 and 116 to be a thickness equal to or greater than a surface depth δ of the material of the magnetic circuit forming members. The surface depth is applied by expression (1).

$$\delta = 503\sqrt{\frac{\rho}{f \cdot \mu_r}} \quad (1)$$

In expression (1), p represents the intrinsic resistivity (electrical resistivity) of the magnetic circuit forming members 112 and 116, f represents frequency, and μr represents the relative magnetic permeability (at room temperature) of the magnetic circuit forming members 112 and 116. Further, even when the magnetic circuit forming members 112 and 116 are sufficiently thick, the temperature distribution, heat generating efficiency and power factor are no problem, but eddy current loss increases depending on the material that is used, so it is preferable to ensure that the magnetic circuit forming members 112 and 116 are not thicker than necessary and for the thickness t to be equal to or less than 1.0 mm when eddy current loss is at a level where there is no problem and the magnetic circuit forming members 112 and 116 are to be easily caused to elastically deform or plastically deform and used.

The original shape of the magnetic circuit forming member 112 in the present exemplary embodiment is substantially that of a flat plate, and thereafter the magnetic circuit forming member 112 is curved into a circular arc shape and supported and used in the state shown in FIG. 2A. When the magnetic circuit forming member 112 is within an elastic deformation region, it is capable of being used in a layout used like a plate spring, whereby it becomes possible to make the flat plate comply as a circular arc-shaped curved support spring, maintain a desired shape, and then be fixed to the bobbin 108 even without press-molding or the like, and advantages are obtained such as it becoming easier to design the magnetic circuit forming member 112 because the magnetic circuit forming member 112 is capable of being easily disposed.

The weight of each of the magnetic circuit forming members 112 and 116 in the present exemplary embodiment is about 3 g, which is about 5 g lighter than one which is formed with a conventional manganese (Mn)-zinc (Zn) based soft ferrite in the same volume, so the weight is reduced by half. Further, because the thickness of a conventional manganese (Mn)-zinc (Zn) based soft ferrite has been about 3 mm, the thickness of the magnetic circuit forming members 112 and 116 becomes equal to or less than ⅓ in comparison to what has conventionally been the case.

It will be noted that because the magnetic circuit forming members 112 and 116 are non-crystalline metal, there are also instances where they can only be molded as thin plates of several tens of μm, so in those instances they are appropriately laminated as far as a submillimeter order and used. Further, when use of thin plates is difficult, it is preferable to make them easier to handle by supporting them with a heat-resistant resin or laminating. As an example, it is easy to handle them when a non-crystalline metal is adhered by a polyimide tape to a heat-resistant resin sheet made of polyimide and used.

Next, a pressing pad 118 for pressing the fixing belt 102 outward with a predetermined pressure is fixed to the end surface of the column portion 114B of the support member 114.

The pressing pad 118 is configured by a member having elasticity, such as urethane rubber or a sponge, and one end surface thereof contacts the inner peripheral surface of the fixing belt 102 and presses the fixing belt 102 outward.

The pressure roll 104 is disposed in a position facing the outer peripheral surface of the fixing belt 102. The pressure roll 104 applies pressure to the fixing belt 102 in the direction of the pressing pad 118 and is driven to rotate in the direction of arrow E by an unillustrated drive mechanism comprising a motor and a gear.

The pressure roll 104 is configured by a core metal 106 comprising a metal such as aluminium, and with the periphery of the core metal 106 being covered by silicon rubber and PFA. Further, the pressure roll 104 is configured to be movable in the directions of arrows A and B using an unillustrated electromagnetic switch such as a solenoid or a cam mechanism. When the pressure roll 104 moves in the direction of arrow A, it contacts and applies pressure to the outer peripheral surface of the fixing belt 102, and when the pressure roll 104 moves in the direction of arrow B, it separates from the outer peripheral surface of the fixing belt 102.

Here, when the pressure roll 104 applies pressure to the fixing belt 102 in the direction of the pressing pad 118, a concave portion 103 is formed in the fixing belt 102, and convex portions 105 are formed on both sides of the concave portion 103, at the portion where the fixing belt 102 and the pressure roll 104 contact each other (nip portion).

The shape of this nip portion curves in the direction where the recording paper P carrying toner T is caused to separate from the fixing belt 102 when the recording paper P passes through the nip portion. For this reason, the recording paper P that is conveyed from the direction of arrow IN is discharged by the rigidity of its own body in the direction of arrow OUT following the shape of the nip portion.

Further, the pressing pad 118 presses the fixing belt 102 against the pressure roll 104, curves following the inner peripheral surface of the fixing belt 102, and widens the nip width.

A thermistor 120 that measures the temperature of the surface of the fixing belt 102 is disposed contacting a region of the surface of the fixing belt 102 that does not face the excitation coil 110 and on the side where the recording paper P is discharged. The position where the thermistor 120 contacts the fixing belt 102 is the substantial center portion in the axial direction of the fixing belt 102 (depth direction of the page of FIG. 2A) to ensure that the measured value does not change depending on the size of the recording paper P.

The resistance of the thermistor 120 changes in response to the amount of heat applied from the surface of the fixing belt 102, whereby the thermistor 120 measures the temperature of the surface of the fixing belt 102.

Figure 3:
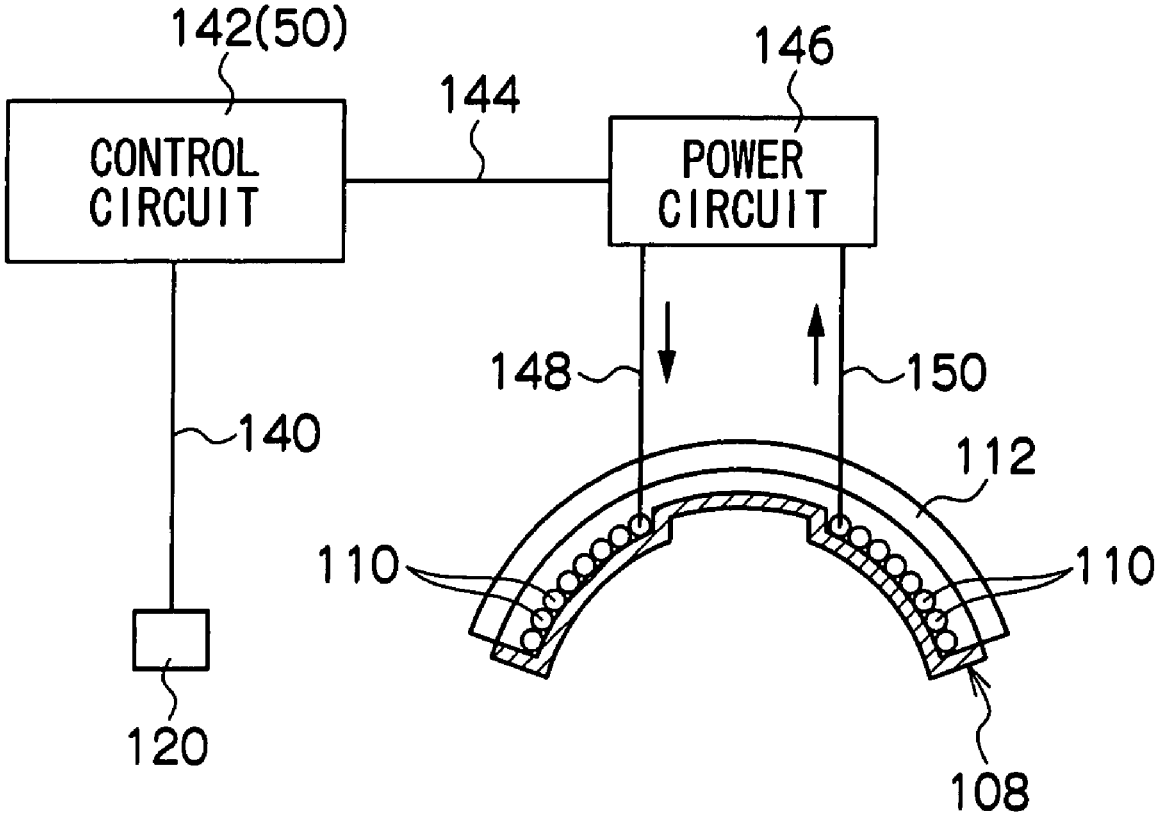
FIG. 3 is a connection diagram of a control circuit and a power circuit pertaining to the first exemplary embodiment of the present invention.

As shown in FIG. 3, the thermistor 120 is connected via a wire 140 to a control circuit 142 that is disposed inside the aforementioned control unit 50 (see FIG. 1). Further, the control circuit 142 is connected via a wire 144 to a power circuit 146, and the power circuit 146 is connected via wires 148 and 150 to the aforementioned excitation coil 110.

Here, the control circuit 142 measures the temperature of the surface of the fixing belt 102 on the basis of the amount of electricity sent from the thermistor 120, and compares this measured temperature with a preset fixing temperature (in the present exemplary embodiment, 170° C.) that is stored in advance. When the measured temperature is lower than the preset fixing temperature, the control circuit 142 drives the power circuit 146 to power the excitation coil 110 and generate the magnetic field H (see FIG. 2A) as a magnetic circuit. When the measured temperature is higher than the preset fixing temperature, the control circuit 142 stops the power circuit 146.

The power circuit 146 is driven or stopped on the basis of an electrical signal sent from the control circuit 142 and is configured to supply or stop supplying an alternating current of a predetermined frequency to the excitation coil 110 via the wires 148 and 150.

Next, the configuration of the fixing belt 102 will be described.

Figure 2B:
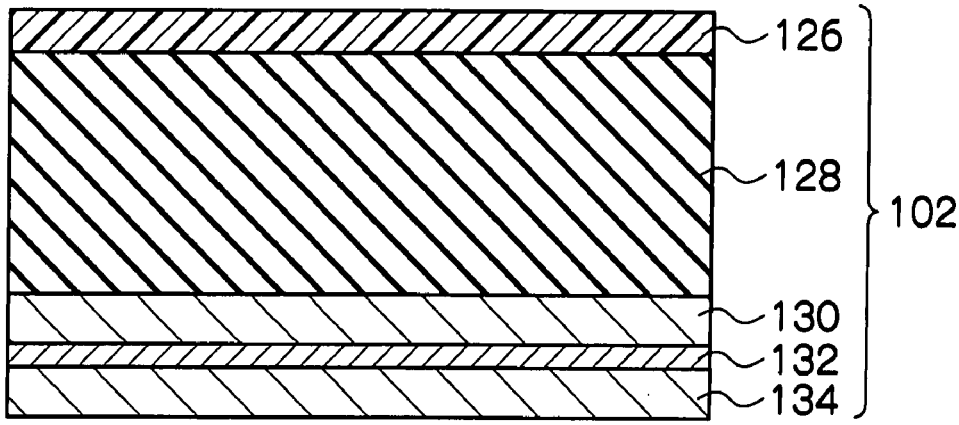
FIG. 2B is a cross-sectional diagram of a fixing belt pertaining to the first exemplary embodiment of the present invention.

As shown in FIG. 2B, the fixing belt 102 is configured, from inside to outside, by a base layer 134, a heat generating layer 132, a protective layer 130, an elastic layer 128 and a separating layer 126. These layers are laminated and integrated.

The base layer 134 serves as a base to maintain the strength of the fixing belt 102 and is configured by nonmagnetic stainless steel (nonmagnetic SUS).

The heat generating layer 132 is a metal material that generates heat by electromagnetic induction action where an eddy current flows so as to generate a magnetic field that counters the aforementioned magnetic field H (see FIG. 2A); for example, a metal material such as gold, silver, copper, aluminium, or an alloy of these, can be used. In the present exemplary embodiment, copper is used as the heat generating layer 132 from the standpoint of its low cost and reducing its intrinsic resistivity to be equal to or less than $2.7\times10^{-8}\Omega$m to efficiently obtain the necessary heating value.

Further, it is preferable for the heat generating layer 132 to be disposed in as thin a layer as possible because the warm-up time of the fixing device 100 can be shortened the smaller the heat capacity of the heat generating layer 132 is. When it is the above-described nonmagnetic metal, heating can be done by a layer with a thickness of 2 μm to 20 μm.

It will be noted with respect to the heat generating layer 132 that it is necessary to make the thickness equal to or greater than 5 μm in order to form a uniform film. For this reason, it is preferable for the thickness of the heat generating layer 132 to be 5 μm or greater and 20 μm or less. In the present exemplary embodiment, the thickness of the heat generating layer 132 is 10 μm.

The protective layer 130 must allow the magnetic field H (see FIG. 2A) from the excitation coil 110 to act on the heat generating layer 132, and it is necessary that the protective layer 130 does not block the magnetic field H or hinder the heat generating efficiency of the heat generating layer 132.

In order to allow the magnetic flux of the aforementioned magnetic field H to penetrate as far as the heat generating layer 132, it is necessary for the surface depth representing the depth to which the magnetic field H can penetrate to be a thickness at least equal to or greater than the sum of the thickness of the protective layer 130 and the thickness of the heat generating layer 132, and a nonmagnetic metal whose surface depth becomes a sufficiently large value (paramagnetic material whose relative magnetic permeability is generally 1) is preferable.

Further, in order to ensure that the protective layer 130 does not hinder the heat generation of the heat generating layer 132, generally a material whose intrinsic resistivity is high and which does not easily generate heat is preferable (ideally, a metal whose relative magnetic permeability equals 1 and whose intrinsic resistance equals ∞).

Moreover, a material whose mechanical strength is higher than that of the heat generating layer 132, and that is resistant to repeated strain, rust and corrosion, is preferable for the protective layer 130.

As a result of these considerations, the protective layer 130 is configured by nonmagnetic stainless steel (intrinsic resistivity of $60\times10^{-8}$ to $90\times10^{-8}\Omega$m), and the thicknesses of the protective layer 130 and the base layer 134 are each 30 μm.

A silicon-based rubber or fluorine-based rubber is preferable for the elastic layer 128 from the standpoint that excellent elasticity and heat resistance are obtained, and silicon rubber is used in the present exemplary embodiment. In the present exemplary embodiment, the thickness of the elastic layer 128 is 200 μm.

The separating layer 126 is disposed in order to weaken the adhesive force between the fixing belt 102 and the toner T (see FIG. 2A) melted on the recording paper P and to make it easier to separate the recording paper P from the fixing belt 102. In order to obtain excellent surface separability, it is preferable to use a fluorine resin, a silicon resin or a polyimide resin for the separating layer 126, and in the present exemplary embodiment, PFA (tetrafluoroethylene perfluoroalkoxyvinylethylene copolymer resin) is used. In the present exemplary embodiment, the thickness of the separating layer 126 is 30 μm.

Next, the action of the first exemplary embodiment of the present invention will be described.

As shown in FIG. 1, the recording paper P to which the toner has been transferred through the aforementioned image forming process of the printer 10 is sent to the fixing device 100.

In the fixing device 100, because of the aforementioned control by the control unit 50, the pressure roll 104 is separated from the surface of the fixing belt 102 until the temperature of the surface of the fixing belt 102 reaches the preset fixing temperature, and when the temperature of the surface of the fixing belt 102 reaches the preset fixing temperature, the pressure roll 104 moves into contact with the surface of the fixing belt 102. The temperature of the surface of the fixing belt 102 temporarily drops due to contact with the pressure roll 104 but reaches the preset fixing temperature as a result of the heat generating layer 132 (see FIG. 2B) continuously generating heat.

As shown in FIG. 2A and FIG. 3, in the fixing device 100, the pressure roll 104 begins to be driven to rotate in the direction of arrow E, and the fixing belt 102 follows that and rotates in the direction of arrow D. At this time, the power circuit 146 is driven on the basis of the aforementioned electrical signal from the control circuit 142, and the alternating current is supplied to the excitation coil 110.

When the alternating current is supplied to the excitation coil 110, the magnetic field H (see FIG. 2A) serving as a magnetic circuit repeatedly generates and extinguishes around the excitation coil 110. Here, the closed magnetic circuit of the magnetic field H is formed between the magnetic circuit forming members 112 and 116.

Figure 5:
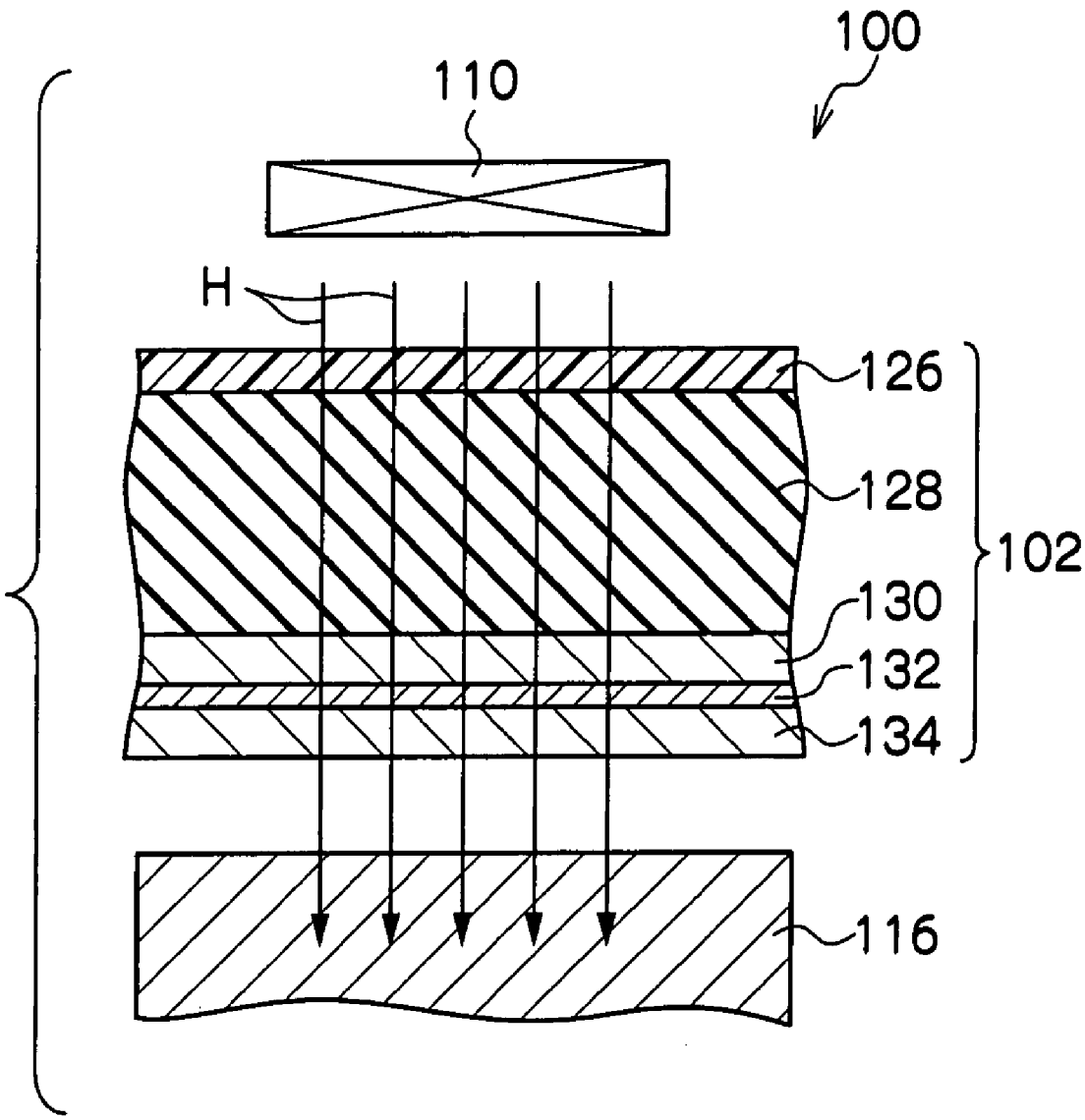
FIG. 5 is a schematic diagram showing a state where a magnetic field penetrates the fixing belt pertaining to the first exemplary embodiment of the present invention.

Then, as shown in FIG. 5, when the magnetic field H crosses the heat generating layer 132 of the fixing belt 102, an eddy current (not shown) is generated in the heat generating layer 132 such that a magnetic field that deters changes in the magnetic field H arises.

The heat generating layer 132 generates heat in proportion to the skin resistance of the heat generating layer 132 and the size of the eddy current flowing through the heat generating layer 132, whereby the fixing belt 102 is heated.

At this time, the magnetic flux density of the magnetic field H (see FIG. 2A) rises and the magnetic field H becomes stronger because the magnetic circuit forming members 112 and 116 have high magnetic permeability. For this reason, the heating value resulting from electromagnetic induction increases and the necessary heating value is obtained. It will be noted that because the magnetic circuit forming members 112 and 116 have high resistivity, it is difficult for the eddy current resulting from electromagnetic induction to flow thereto, and the magnetic circuit forming members 112 and 116 do not generate heat and affect the temperature of the fixing belt 102.

The temperature of the surface of the fixing belt 102 is detected by the thermistor 120 as shown in FIG. 3, and when the temperature has not reached the preset fixing temperature of 160° C., the control circuit 142 controls the driving of the power circuit 146 to supply the alternating current of the predetermined frequency to the excitation coil 110. When the temperature has reached the preset fixing temperature, the control circuit 142 stops control of the power circuit 146.

Next, as shown in FIG. 2A, the recording paper P that has been fed into the fixing device 100 is heated and pressed by the fixing belt 102, whose surface temperature has reached the predetermined preset fixing temperature (170° C.) as a result of the heat generating layer 132 generating heat, and the pressure roll 104, whereby the image of the toner T is fixed to the surface of the recording paper P.

When the recording paper P is fed out from the nip portion between the fixing belt 102 and the pressure roll 104, the recording paper P is separated from the fixing belt 102 because it tries to move straightly in the direction along the nip portion because of its own rigidity.

The recording paper P that has been discharged from the fixing device 100 is discharged into the tray 38 by the paper conveying rolls 36.

It will be noted that at least one of the magnetic circuit forming members 112 and 116 are capable of having either elastic deformation or plastic deformation applied thereto and being used so that they can be adjusted and disposed to match the shape of the excitation coil 110 or the fixing belt 102.

Further, as mentioned previously, the magnetic circuit forming members 112 and 116 are lightweight (equal to or less than half of what has conventionally been the case) and thin (equal to or less than ⅓ of what has conventionally been the case), whereby closed magnetic circuit forming members that are difficult to break can be formed.

Next, a second exemplary embodiment of a fixing device and an image forming apparatus of the present invention will be described on the basis of the drawings.

It will be noted that reference numerals that are the same as those of the first exemplary embodiment will be given to parts that are basically the same as those of the first exemplary embodiment and that description of those same parts will be omitted.

In the present exemplary embodiment, the fixing device 100 in the aforementioned printer 10 (see FIG. 1) is replaced by a fixing device 170.

Figure 4B:
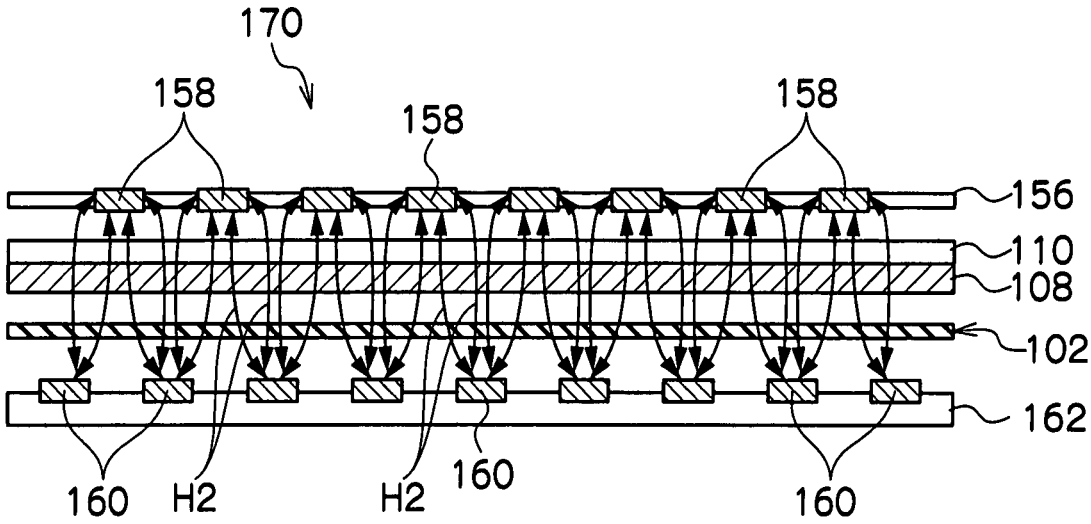
FIG. 4B is a schematic diagram showing the arrangement of magnetic circuit forming members pertaining to a second exemplary embodiment of the present invention.

As shown in FIG. 4B, disposed in the fixing device 170 are the aforementioned fixing belt 102, bobbin 108 and excitation coil 110, and also magnetic circuit forming members 158 and 160.

The magnetic circuit forming members 158 have a Curie temperature that is equal to or higher than the heat generating temperature of the excitation coil 110 (in the present exemplary embodiment, 170° C.) and equal to or less than the allowable temperature limit of the excitation coil 110 (in the present exemplary embodiment, 250° C.). Further, the magnetic circuit forming members 160 have a Curie temperature that is equal to or higher than the preset fixing temperature (in the present exemplary embodiment, 160° C.) and equal to or less than the allowable temperature limit (in the present exemplary embodiment, 240° C.) of the aforementioned fixing belt 102 (see FIG. 2A). In the present exemplary embodiment, the same material whose Curie temperature is 210° C. is used for the magnetic circuit forming members 158 and 160. Of course, different materials may also be used for the magnetic circuit forming members 158 and 160. It will be noted that the temperature compensator alloys (magnetic shunt alloys) MS-170, 205, and 220 of Neomax Material Co., Ltd., for example, can be used for the magnetic circuit forming members 158 and 160.

The magnetic circuit forming members 158 may be configured by arranging small pieces (segments) of plural magnetic circuit forming members 158 formed in substantial C-shapes along the entire surface in the axial direction, but in the present exemplary embodiment, in order to reduce the use amount as much as possible, the magnetic circuit forming members 158 have a configuration where they are arranged in the axial direction of the fixing belt 102 with predetermined gaps disposed therebetween and are supported by a support member 156 that is disposed between the magnetic circuit forming members 158 and the aforementioned casing 122 (see FIG. 2A).

The magnetic circuit forming members 160 may also be configured by arranging small pieces along the entire surface in the axial direction, but in order to reduce the use amount as much as possible, the magnetic circuit forming members 160 have a configuration where small pieces of plural magnetic circuit forming members 160 formed in substantial C-shapes are arranged in the axial direction of the fixing belt 102 with predetermined gaps disposed therebetween and are supported by a support member 162 that is disposed in place of the aforementioned support member 114.

Here, the magnetic circuit forming members 158 and the magnetic circuit forming members 160 are disposed in a staggered manner, and magnetic fields H2 generated by the excitation coil 110 form respectively closed magnetic circuits as shown in FIG. 4B.

It will be noted that the aforementioned wires 148 and 150 (see FIG. 3) connected to the excitation coil 110 are led to the outside through the gaps between the magnetic circuit forming members 158 and connected to the power circuit 146 (see FIG. 3).

Next, the action of the second exemplary embodiment of the present invention will be described.

As shown in FIG. 4B, when the fixing device 170 begins operation and the alternating current is supplied to the excitation coil 110 from the aforementioned power circuit 146 (see FIG. 3), the magnetic fields H2 serving as magnetic circuits repeatedly generate and extinguish around the excitation coil 110. Here, the closed magnetic circuits of the magnetic fields H2 are formed between the magnetic circuit forming members 158 and 160.

Then, when the magnetic fields H2 cross the heat generating layer 132 (see FIG. 2B) of the fixing belt 102, an eddy current (not shown) is generated in the heat generating layer 132 such that a magnetic field that deters changes in the magnetic fields H2 arises.

The heat generating layer 132 generates heat in proportion to the skin resistance of the heat generating layer 132 and the size of the eddy current flowing through the heat generating layer 132, whereby the fixing belt 102 is heated.

Here, when the heat generating layer 132 excessively generates heat and the temperature of the fixing belt 102 becomes higher than the preset fixing temperature and the temperatures of the magnetic circuit forming members 158 and 160 exceed their Curie temperatures, the magnetic circuit forming members 158 and 160 become nonmagnetic bodies (paramagnetic bodies), the magnetic fields H2 easily pass through these, and the magnetic fields H2 weaken. Thus, the heating value of the heat generating layer 132 is reduced and the temperature of the fixing belt 102 drops. For example, in a case where a recording medium that is smaller than the width of the fixing belt 102 is fixed, when the temperature of the portion of the fixing belt 102 that does not contact the recording medium (portion along which the paper does not pass)

becomes high and the temperature of the magnetic circuit forming members 160 exceeds the Curie temperature, the heating value of the portion of the fixing belt 102 along which the paper does not pass is reduced. Further, when the temperature of the excitation coil 110 becomes high and the temperature of the magnetic circuit forming members 158 exceeds the Curie temperature, the heating value of the fixing belt 102 is reduced so that the amount of heat applied to the fixing device 170 itself can be kept low.

Further, the magnetic fields H2 become strong at the portions where the magnetic circuit forming members 158 and 160 are, and the portions in the gaps become weak. Because the wires 148 and 150 (see FIG. 3) are connected in the gaps where the magnetic fields H2 are weak, it is difficult for the wires 148 and 150 to be affected by noise resulting from the magnetic fields H2, or the wires 148 and 150 are prevented from generating heat.

The present invention is not limited to the above-described exemplary embodiments.

The printer 10 may be not only one using a dry electrophotographic system using solid developer but may also be one using liquid developer.

As the means for detecting the temperature of the fixing belt 102, a thermocouple may also be used instead of the thermistor 120.

The attachment position of the thermistor 120 is not limited to the top surface of the fixing belt 102. For example, the thermistor 120 may also be attached to the inner peripheral surface of the fixing belt 102. In this case, it becomes difficult for the surface of the fixing belt 102 to wear. Further, the thermistor 120 may also be attached to the surface of the pressure roll 104.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a magnetic field generating component that generates a magnetic field;

a fixing member including a heat generating layer that is electromagnetically induced by the magnetic field to generate heat;

a support disposed at an inner side of the fixing member;

a pressure rotating body that applies pressure to the fixing member in the direction of the support;

a pair of magnetic circuit forming members that are disposed with the fixing member and the magnetic field generating component being placed therebetween and at least one of said magnetic circuit forming members having been shaped either by elastic deformation or plastic deformation applied thereto and wherein a thickness t of the magnetic circuit forming members is thicker than a surface depth δ of the material of the magnetic circuit forming members as defined by the equation $\delta=503(\rho/\gamma\mu_r)^{1/2}$, wherein ρ represents the intrinsic resistivity of the magnetic circuit forming members, γ represents the frequency of the magnetic field generating component, and $\mu_r$ represents the relative magnetic permeability at room temperature of the magnetic circuit forming members.

2. The fixing device of claim 1, wherein the magnetic circuit forming members are closed magnetic circuit forming members that form a closed magnetic circuit when the magnetic field is generated by the magnetic field generating component.

3. The fixing device of claim 1, wherein the magnetic circuit forming members include a non-crystalline metal.

4. The fixing device of claim 1, wherein the magnetic circuit forming members have a multilayer structure.

5. The fixing device of claim 1, wherein the magnetic circuit forming members include a layer including a non-crystalline metal.

6. The fixing device of claim 1, wherein a magnetic circuit forming member disposed at a side of the fixing member has a Curie temperature that is equal to or higher than a preset fixing temperature and equal to or lower than an allowable temperature limit of the fixing member.

7. The fixing device of claim 1, wherein a magnetic circuit forming member disposed at a side of the magnetic field generating component has a Curie temperature that is equal to or higher than a heat generating temperature of the magnetic field generating component and equal to or lower than an allowable temperature limit of the magnetic field generating component.

8. The fixing device of claim 1, wherein the fixing member has an endless belt shape and has two end portions that are rotatably supported.

9. The fixing device of claim 1, wherein each of the pair of magnetic circuit forming members has a plate shape and includes a curved surface at a side facing the fixing member or the magnetic field generating component.

10. The fixing device of claim 1, wherein each of the pair of magnetic circuit forming members is formed from plural segments divided along a rotational axis direction of the fixing member, and the plural segments are disposed so as to include predetermined gaps in the rotational axis direction.

11. The fixing device of claim 10, wherein the segments configuring one of the magnetic circuit forming members of the pair of magnetic circuit forming members are disposed so as to be positioned between the segments configuring the other magnetic circuit forming member that are adjacent in the rotational axis direction.

12. The fixing device of claim 1, wherein the magnetic circuit forming members are configured to include a support layer of a heat-resistant resin.

13. The fixing device of claim 1, wherein the magnetic circuit forming members are laminated with a heat-resistant resin.

14. An image forming apparatus comprising:

an exposing component that emits exposure light;

a developing component that develops, with developer, a latent image formed by the exposure light of the exposing component, to form a developer image;

a transfer component that transfers, onto a recording medium, the developer image developed by the developing component; and a fixing device that fixes the developer image that has been transferred onto the recording medium, the fixing device including a magnetic field generating component that generates a magnetic field, a fixing member including a heat generating layer that is electromagnetically induced by the magnetic field to generate heat, a support disposed at an inner side of the fixing member, a pressure rotating body that applies pressure to the fixing member in the direction of the support, a pair of magnetic circuit forming members that are disposed with the fixing member and the magnetic field generating component being placed therebetween and the pair of magnetic circuit forming members having been shaped either by elastic deformation or plastic deformation applied thereto and wherein a thickness t of the magnetic circuit forming members is thicker than a surface depth δ of the material of the magnetic circuit forming members as defined by the equation $\delta=503(\rho/\gamma\mu_r)^{1/2}$, wherein ρ represents the intrinsic resistivity of the magnetic circuit forming members, γ represents the frequency of the magnetic field generating component, and $\mu_r$ represents the relative magnetic permeability at room temperature of the magnetic circuit forming members.

* * * * *